US006700317B2

(12) United States Patent
Kanao et al.

(10) Patent No.: US 6,700,317 B2
(45) Date of Patent: Mar. 2, 2004

(54) SPARK PLUG FOR AN INTERNAL COMBUSTION ENGINE AND MANUFACTURING METHOD OF THE SAME

(75) Inventors: Keiji Kanao, Aichi-ken (JP); Kouzou Takamura, Nagoya (JP)

(73) Assignee: Denso Corporation (JP)

( * ) Notice: Subject to any disclaimer, the term of this patent is extended or adjusted under 35 U.S.C. 154(b) by 161 days.

(21) Appl. No.: 09/818,784

(22) Filed: Mar. 28, 2001

(65) Prior Publication Data

US 2001/0030495 A1 Oct. 18, 2001

(30) Foreign Application Priority Data

Mar. 28, 2000 (JP) ..... 2000-093012

(51) Int. Cl.[7] ..... H01T 13/20; H01T 21/02
(52) U.S. Cl. ..... 313/141; 445/7
(58) Field of Search ..... 313/141, 144, 313/133, 118; 445/7; 123/169 EL, 169 MG

(56) References Cited

U.S. PATENT DOCUMENTS 3,548,239 A * 12/1970 Eaton ..... 313/136
4,514,657 A * 4/1985 Igashira et al. ..... 313/130
4,539,503 A * 9/1985 Esper et al. ..... 313/11.5
5,371,335 A * 12/1994 McKeon et al. ..... 219/117.1
5,488,262 A * 1/1996 Takamura ..... 313/141
5,869,921 A * 2/1999 Matsutani et al. ..... 313/141
6,147,441 A * 11/2000 Osamura ..... 313/141
6,232,704 B1 * 5/2001 Herweg et al. ..... 313/141

* cited by examiner

*Primary Examiner*—Nimeshkumar D. Patel
*Assistant Examiner*—Anthony Perry
(74) *Attorney, Agent, or Firm*—Nixon & Vanderhye PC

(57) ABSTRACT

An iridium alloy firing tip, fixed to a center electrode, comprises a stem and a head. The firing tip head is integrally formed from one end of the stem. A distal end of the stem is opposed to an opponent electrode. The head is embedded in the opposing portion. The firing tip head is pointed or tapered in a direction opposite to the stem from a maximum diameter portion in such a manner that a cross-sectional area of the head continuously decreases with increasing distance from the maximum diameter portion. The maximum diameter portion is positioned deeply inside the opposing portion, and a base end of the stem extending from the maximum diameter portion is wrapped or surrounded by the opposing portion.

5 Claims, 8 Drawing Sheets

SPARK PLUG FOR AN INTERNAL COMBUSTION ENGINE AND MANUFACTURING METHOD OF THE SAME

BACKGROUND OF THE INVENTION

The present invention relates to a spark plug for an internal combustion engine comprising a center electrode and a ground electrode disposed in an opposed relationship and an iridium (Ir) alloy firing tip provided on at least one of opposing portions of the electrodes. Furthermore, the present invention relates to a method for manufacturing this spark plug.

Spark plugs are employed in internal combustion engines of automotive vehicles, cogeneration facilities and gas compressors. For example, to extend lifetime and improve performance of the spark plug, a spark discharge electrode member, made of platinum (Pt) or Pt alloy, is disposed on at least one of opposing portions of the center and ground electrodes disposed in an opposed relationship.

U.S. Pat. No. 5,456,624 discloses this type of conventional spark plug which uses a rivet platinum firing tip having a head formed at a front end thereof. The head of the firing tip is fixed to an opposing electrode surface by resistance welding.

The spark plugs in future will be subjected to severe engine specifications, i.e., will be used in thermally severe environments. It is predicted that wearability of the firing tip, if it is made of Pt alloy, will be insufficient in such severe conditions. Regarding the wearability, the melting point of iridium (Ir) alloy is higher than that of the Pt alloy. Thus, the iridium alloy is believed to be a prospective material for the future spark discharge electrode member.

The inventors of this application have conducted durability tests on some samples prepared based on conventional spark plug arrangement employing Ir alloy firing tips, with a conclusion that fixation of the Ir alloy firing tip is insufficient according to the conventional spark plug.

More specifically, according to the above-described conventional spark plug, the firing tip is shallowly welded on the opposing electrode surface in such a manner that only a front end or top of the firing tip head sinks in the opposing electrode. If the firing tip is made of Pt or Pt alloy having a linear expansion coefficient similar to that of the electrode base material (Ni-based alloy or the like), it will be possible to obtain sufficient bonding strength and durability.

However, when the firing tip is made of Ir alloy having a linear expansion coefficient larger than that of the electrode base material, the conventional firing tip arrangement cannot assure sufficient bonding strength and durability. In fact, according to an engine test based on practical environments, the firing tip has fallen out of the electrode. Alternatively, it may be possible to use a laser welding for connecting the Ir alloy firing tip to the electrode. However, the laser welding is expensive compared with the resistance welding.

SUMMARY OF THE INVENTION

In view of the above-described problems, the present invention has an object to provide a spark plug for an internal combustion engine comprising a center electrode and a ground electrode disposed in an opposed relationship and an iridium alloy firing tip provided on at least one of opposing portions of the electrodes. More specifically, the present invention provides a low-cost method for surely fixing the iridium alloy firing tip to the electrode.

To accomplish the above and other related objects, the present invention provides a first spark plug for an internal combustion engine comprising a center electrode and a ground electrode disposed in an opposed relationship, and an iridium alloy firing tip provided on at least one of opposing portions of said electrodes. The iridium alloy firing tip comprises a stem and a head. The firing tip head is integrally formed from one end of the stem with a diameter of the head larger than a diameter of the stem. A distal end of the firing tip stem is opposed to an opponent electrode. The head is embedded in the opposing portion of the electrode. The head is pointed or tapered in a direction opposite to the stem from a maximum diameter portion in such a manner that a cross-sectional area of the head continuously decreases with increasing distance from the maximum diameter portion. The maximum diameter portion is positioned inside the opposing portion of the electrode, and a base end of the stem extending from the maximum diameter portion is wrapped or surrounded by the opposing portion of the electrode.

According to the first spark plug of the present invention, the front end (i.e., top) of the firing tip head is pointed or tapered from the maximum diameter portion in such a manner that the cross-sectional area of the firing tip head continuously decreases with increasing distance from the maximum diameter portion (hereinafter, referred to as tapered configuration of the firing tip head). Thus, when a pressing force is applied during the low-cost resistance welding, the firing tip head can easily sink in the melted opposing portion of the electrode.

According to the embedding arrangement of the first spark plug, the opposing portion of the electrode surrounds or wraps the maximum diameter portion of the firing tip head as well as the base end of the stem extending from the maximum diameter portion. Thus, it becomes possible to securely fix the Ir alloy firing tip to the opposing portion of the electrode in a hooked condition, thereby effectively preventing the Ir alloy firing tip from being mechanically pulled out of the electrode. Hence, the first spark plug of the present invention makes it possible to prevent the Ir alloy firing tip from falling out of the electrode based on low-cost resistance welding.

According to the first spark plug of the present invention, it is preferable that the opposing portion of the electrode surrounds or wraps the firing tip head by a thickness t1 equal to or larger than 0.3 mm. The thickness t1 satisfying this condition assures a sufficient force for fixing the Ir ally firing tip to the opposing portion of the electrode.

Furthermore, according to the first spark plug of the present invention, it is preferable that a pointed or tapered end of the firing tip head is configured into a spherical surface. Alternatively, it is preferable that the pointed or tapered end of the firing tip head is configured into a flattened surface which satisfies a relationship $A<D/2$, where "A" represents a planar length of the flattened surface and "D" represents a diameter of the maximum diameter portion. If the planar length "A" is equal to or larger than D/2, the firing tip head will not smoothly sink in the opposing portion of the electrode during the resistance welding operation.

Furthermore, the present invention provides a manufacturing method for a spark plug employed in an internal combustion engine, the spark plug comprising a center electrode and a ground electrode disposed in an opposed relationship, and an iridium alloy firing tip fixed to at least one of opposing portions of the electrodes by resistance welding, wherein the iridium alloy firing tip comprises a stem and a head, the firing tip head being integrally formed from one end of the stem with a diameter of the head larger than a diameter of the stem. This manufacturing method comprises a welding operation for fixing the iridium firing tip to the opposing portion of the electrode by resistance welding. The welding operation comprises a step of bringing the head of the iridium alloy firing tip into contact with the opposing portion of the electrode, and a step of applying a pressing force to the head during resistance welding operation for enforcing a maximum diameter portion to sink in a melted portion of the electrode until a base end of the stem extending from the maximum diameter portion is embedded in the melted portion of the electrode.

According to the manufacturing method of the present invention, the above-described first spark plug can be manufactured adequately. During resistance welding operation, the firing tip head sinks in the melted portion of the electrode when it thermally deforms due to welding heat. This makes it possible to surround or wrap the base end of the stem extending from the maximum diameter portion. Alternatively, according to the present invention, it is possible to caulk the opposing portion of the electrode after the firing tip head is embedded in the opposing portion of the electrode.

Furthermore, the present invention provides a second spark plug for an internal combustion engine comprising a center electrode and a ground electrode disposed in an opposed relationship, and an iridium alloy firing tip provided on at least one of opposing portions of said electrodes. The iridium alloy firing tip comprises a stem and a head. The firing tip head is integrally formed from one end of the stem with a diameter of the head larger than a diameter of the stem. A distal end of the firing tip stem is opposed to an opponent electrode. The firing tip head is placed in a hole formed in the opposing portion of the electrode. The head has a maximum diameter portion positioned in the hole. The opposing portion of the electrode is caulked so that a base end of the stem extending from the maximum diameter portion is wrapped or surrounded by an inside wall of the hole.

According to the second spark plug of this present invention, the firing tip head is securely fixed in the hole with the maximum diameter portion placed in the hole and the stem surrounded by the deformed inside wall of the hole. Accordingly, it becomes possible to securely fix the Ir alloy firing tip to the opposing portion of the electrode in a hooked condition, thereby effectively preventing the Ir alloy firing tip from being mechanically pulled out of the opposing portion of the electrode. Thus, according to the second spark plug of the present invention, it becomes possible to effectively fixing the Ir alloy firing tip to the electrode based on low-cost caulking operation.

Furthermore, the present invention provides a third spark plug for an internal combustion engine comprising a center electrode and a ground electrode disposed in an opposed relationship, and an iridium alloy firing tip provided on an opposing portion of said ground electrode. The iridium alloy firing tip is provided on an opposing portion of the ground electrode. The iridium alloy firing tip comprises a stem and two heads formed at both ends of this stem, with a diameter of each head larger than a diameter of the stem. A through-hole, provided on the opposing portion of the electrode, accommodates the stem. Two heads are fixed to the opposing portion of the electrode so as to close each end of the through-hole.

According to the third spark plug of this present invention, the heads are fixed to the opposing portion of the electrode so as to close the both ends of the through-hole. Thus, it becomes possible to securely fix the Ir alloy firing tip to the opposing portion of the electrode in a hooked condition, thereby effectively preventing the Ir alloy firing tip from being mechanically pulled out of the opposing portion of the electrode. This arrangement can be easily realized, for example, by inserting an Ir alloy tip rod into a through-hole and deforming a protruding portion of the tip rod to form the firing tip head. Thus, according to the third spark plug of the present invention, it becomes possible to effectively fixing the Ir alloy firing tip to the opposing portion of the electrode based on low-cost operation.

According to the present invention, the iridium alloy firing tip chiefly contains iridium with at least one additive selected from the group consisting of rhodium (Rh), platinum (Pt), ruthenium (Ru), palladium (Pd) and tungsten (W).

BRIEF DESCRIPTION OF THE DRAWINGS

The above and other objects, features and advantages of the present invention will become more apparent from the following detailed description which is to be read in conjunction with the accompanying drawings, in which.

DESCRIPTION OF PREFERRED EMBODIMENTS

Hereinafter, preferred embodiments of the present invention will be explained with reference to attached drawings.

First Embodiment

Figure 1:
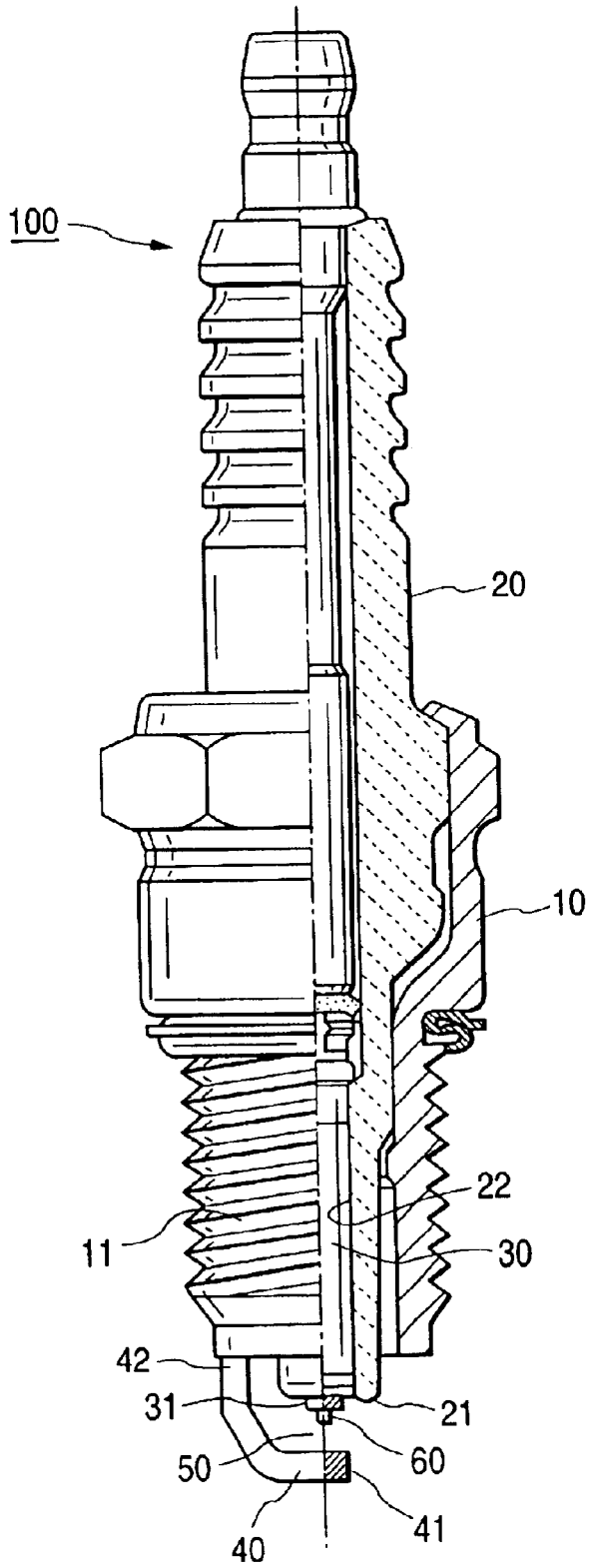
FIG. 1 is a half cross-sectional view showing overall arrangement of a spark plug in accordance with a first embodiment of the present invention.

FIG. 1 is a half cross-sectional view showing overall arrangement of a spark plug 100 in accordance with a first embodiment of the present invention. The spark plug 100 is applicable as an ignitor to an internal combustion engine of an automotive vehicle. The spark plug 100 is inserted into and fixedly engaged with a screw hole opened on an engine head (not shown) which forms and defines a combustion chamber of the engine.

The spark plug 100 has a cylindrical metal fitting (i.e., mounting bracket) 10 made of electrically conductive steel material (e.g., low-carbon steel). The metal fitting 10 has a thread ridge 11 which is securely engaged with a corresponding thread hole formed on the engine head. An insulator 20, made of alumina ceramic ($Al_2O_3$) etc., is securely coupled in an inside hollow space of the metal fitting 10. The insulator 20 has a front end 21 exposed to the outside from an opening of one axial end of the metal fitting 10.

The insulator 20 has an axially extending inside hole 22 for securely supporting a center electrode 30 therein. Thus, the metal fitting 10 supports the center electrode 30 via the insulator 20. The center electrode 30 is a columnar member which has an inside metallic member, such as Cu (i.e., copper), having excellent thermal conductivity and an outside metallic member, such as Ni (i.e., nickel)-based alloy, having excellent heat resistivity and corrosive resistivity. As shown in FIG. 1, a front end 31 of the center electrode 30 is exposed to the outside from the front end 21 of the insulator 20.

A ground electrode 40 has a proximal end 42 fixed to the axial end of the metal fitting 10, an intermediate portion substantially bent into an L shape, and a distal end 41 opposing via a discharging gap 50 to the front end 31 of the center electrode 30. The ground electrode 40 is a square rod member made of a Ni-based alloy or the like.

The front end 31 of the center electrode 30 and the distal end 41 of the ground electrode 40 serve as opposing portions of the electrodes of the present invention. According to the first embodiment, an Ir alloy firing tip 60 is attached on the front end 31 of the center electrode 30 by resistance welding. The Ir alloy firing tip 60 serves as a spark discharge electrode member.

The firing tip 60 chiefly contains Ir (iridium) with at least one additive selected from the group consisting of rhodium (Rh), platinum (Pt), ruthenium (Ru), palladium (Pd) and tungsten (W). For example, the firing tip 60 is an Ir-10Rh alloy with 90 weight % Ir and 10 weight % Rh. The discharge gap 50 is a clearance between the firing tip 60 and the distal end 41 of the ground electrode 40. For example, the discharge gap 50 is approximately 1 mm.

Figure 2:
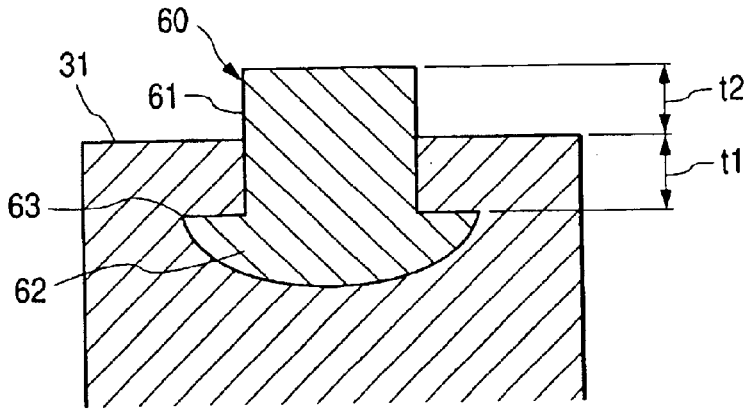
FIG. 2 is an enlarged cross-sectional view showing a firing tip fixed on the front end of a center electrode of the spark plug shown in FIG. 1.

FIG. 2 is an enlarged cross-sectional view showing the Ir alloy firing tip 60 welded to the front end 31 of the center electrode 30.

Figure 3A:
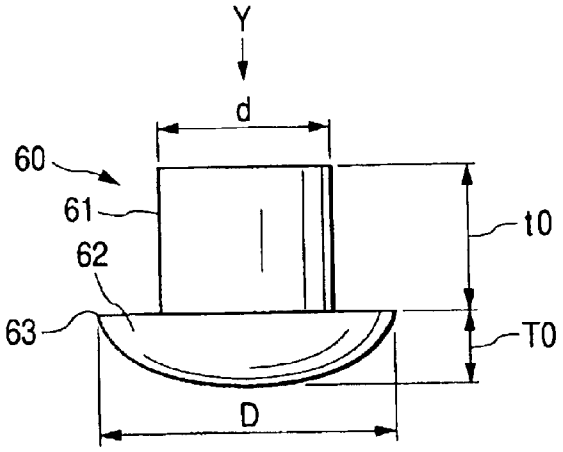
FIGS. 3A and 3B are views showing appearance and configuration of Ir alloy firing tip itself in accordance with the first embodiment of the present invention.
Figure 3B:
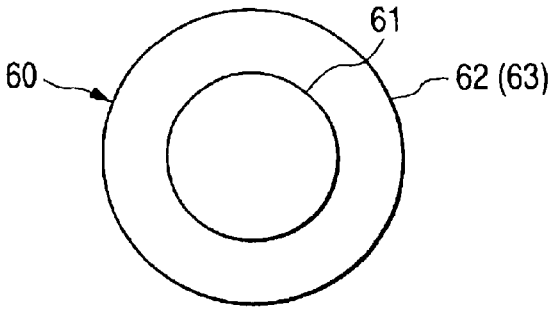

FIGS. 3A and 3B show appearance and configuration of the Ir alloy firing tip 60 itself. FIG. 3B shows the Ir alloy firing tip 60 seen from the direction of an arrow Y shown in FIG. 3A. The Ir alloy firing tip 60 has a circular stem 61 with a diameter "d" and a length "t0" which is integrally formed from a circular head 62. The firing tip head 62 has a diameter larger than that (i.e., diameter "d") of the circular stem 61. In other words, the Ir alloy firing tip 60 is configured into a rivet shape. For example, the Ir alloy firing tip 60 can be formed by cold forging or hot forging the Ir alloy.

According to this embodiment, the circular firing tip head 62 has a maximum diameter (i.e., D as shown in FIG. 3A) at a maximum diameter portion 63. The maximum diameter portion 63 is a bottom flat portion closest to the circular stem 61 of the firing tip 60. The opposite side (i.e., top) of the circular head 62 is configured into a spherical shape. The diameter of the circular head 62 gradually decreases with increasing distance from the maximum diameter portion 63 (due to tapered configuration of the firing tip head). Accordingly, when taken along a plane normal to the axis of the stem 61 (refer to FIG. 2), the cross-sectional area of the circular head 62 continuously decreases with increasing distance from the maximum diameter portion 63.

As shown in FIG. 2, the maximum diameter portion 63 of the circular head 62 is embedded in the front end (i.e. one opposing portion) 31 of the center electrode 30. A free end of the circular stem 61 is directed toward the distal end (i.e., the other opposing portion) 41 of the ground electrode 40. The circular head 62 is deeply positioned so as to be completely embedded in the front end 31 of the center electrode 30. The base end of the circular stem 61 extending from the maximum diameter portion 63 is also embedded in the front end 31 of the center electrode 30.

Next, a manufacturing method for the above-described spark plug 100 will be explained chiefly for a step of fixing the Ir alloy firing tip 60 to the front end 31 of the center electrode 30 in the following manner. Regarding manufacturing steps for other portions of the spark plug 100 are conventionally known and therefore not explained.

This embodiment employs the resistance welding for fixing the Ir alloy firing tip 60 to the front end 31 of the center electrode 30. The Ir alloy firing tip 60 is held up side down relative to the center electrode 30. More specifically, the front end (i.e., top) of the circular head 62 is brought into contact with the front end 31 of the center electrode 30 while a pressing force is applied to the circular stem 61 in the axial direction. Holding this state, the resistance welding is performed.

During the resistance welding operation, the front end 31 of the center electrode 30 melts due to welding heat and the circular head 62 sinks into melted portion of the center electrode 30 due to the pressing force applied thereon. Deformation of the front end 31 of the center electrode 30 results in a condition that the base end of the circular stem 61 extending from the maximum diameter portion 63 is embedded together with the circular head 62 in the melted front end 31 of the center electrode 30 as shown in FIG. 2. In other words, deformation of the center electrode 30 advances in such a manner that the maximum diameter portion 63 of the circular head 62 is gradually surrounded or wrapped by the melted front end 31 of the center electrode 30. Thus, as a result of resistance welding operation, the circular head 62 of the Ir alloy firing tip 60 is completely embedded in the center electrode 30 as shown in FIG. 2.

According to the spark plug 100 of this embodiment, the front end (i.e., top) of the circular head 62 is pointed or tapered in a direction opposite to the stem 61 from its maximum diameter portion 63 in such a manner that the cross-sectional area of the circular head 62 continuously decreases with increasing distance from the maximum diameter portion 63. Thus, when a pressing force is applied during the resistance welding operation as described above, the circular head 62 can easily sink in the melted portion of the center electrode 30.

According to the embedding arrangement for the Ir alloy firing tip 60, the front end 31 of the center electrode 30 surrounds or wraps the entire body of the circular head 62 as well as the base end of the circular stem 61 extending from the maximum diameter portion 63. Thus, it becomes possible to securely fix the Ir alloy firing tip 60 to the front end (i.e., opposing portion) 31 of the center electrode 30 in a hooked condition, thereby effectively preventing the Ir alloy firing tip 60 from being mechanically pulled out of the center electrode 30. Hence, the spark plug 100 of this embodiment makes it possible to realize reliable fixation of Ir alloy firing tip 60 to the opposing portion 31 based on low-cost resistance welding, i.e., without relying on expensive laser welding.

However, the above-described fixing method based on the resistance welding can be modified in the following manner. After embedding the circular head 62 into the opposing portion 31 of the center electrode 30, the opposing portion 31 can be caulked so as to surround or wrap the entire body of the circular head 62 as well as the base end of the circular stem 61 extending from the maximum diameter portion 63. This makes it possible to ensure accurate surrounding or wrapping shape of the opposing portion of the electrode.

Next, shape of Ir alloy firing tip 60 according to this embodiment and its embedded arrangement will be explained in more detail.

In the Ir alloy firing tip 60 shown in FIGS. 3A and 3B, a preferable range of the diameter "d" (hereinafter referred to as thin diameter "d") of the circular stem (i.e., discharge side smaller diameter portion) 61 is in a range of 0.3 mm to 0.8 mm. When the circular stem 61 satisfies this condition, the electric field can be strengthened while the mechanical strength can be assured.

Regarding the relationship between the thin diameter "d" and the maximum diameter D of the circular head 62, it is desirable that the maximum diameter D is within a range of (d+0.2) mm to (d+0.8) mm. When the difference between the maximum diameter D and the thin diameter "d" is less than 0.2 mm, a hooking depth of the center electrode 30 relative to the circular head 62 is so shallow that an insufficient force will be obtained for securely holding the circular head 62. When the difference between the maximum diameter D and the thin diameter "d" is larger than 0.8 mm, the firing tip 60 will no sink in the melted portion of the center electrode 30.

The thickness T0 (in the axial direction of firing tip 60) of the circular head 62 should be determined considering the following points. When the thickness T0 is too thick, the circular head 62 cannot completely sink in the front end (i.e., opposing portion) 31 of the center electrode 30. When the thickness T0 is too thin, the circular head 62 will deform and cannot assure a sufficient fixing force for preventing the Ir alloy firing tip 60 from falling out of the opposing portion 31. For example, an appropriate value of the thickness T0 of the circular head 62 is 0.3 mm.

Furthermore, it is desirable that a thickness (i.e., surrounding or wrapping depth) t1 of the opposing portion 31 relative to the circular head 62 is equal to or larger than 0.3 mm. This value is based on practical-level durability test (e.g., durability test equivalent to traveling distance 100,000 km based on actual vehicle) conducted on the spark plug 100 for checking the effect of preventing the Ir alloy firing tip 60 from falling out of the opposing portion 31. When the thickness t1 is equal to or larger than 0.3 mm, a sufficient force can be obtained for fixing the Ir alloy firing tip 60 to the opposing portion 31, thereby assuring the above-described anti-falling effect.

Furthermore, it is desirable that a length (i.e., stem protruding length) t2 of the stem 61 protruding relative to the opposing portion 31 is equal to or larger than 0.3 mm. When the stem protruding length t2 is too short, spark discharge may occur at an unpredictable point on the opposing portion (i.e., front end of center electrode) 31 other than the stem 61. The opposing portion 31 may be so exhausted that the Ir alloy firing tip 60 falls out of the opposing portion 31.

Furthermore, it is desirable that a length t0 of the stem 61 is equal to or larger than 0.6 mm in view of preferable values of the surrounding or wrapping depth t1 (≧0.3 mm) and the stem protruding length t2 (≧0.3 mm). When the length t0 of the stem 61 is too long, the stem 61 may cause buckling when a pressing force is applied during the resistance welding. The length t0 of the stem 61 should be determined based on such considerations, and is preferably equal to or larger than 0.6 mm.

Figure 4A:
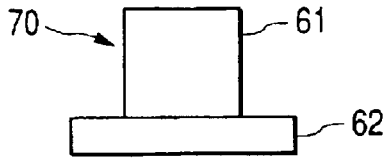
FIG. 4A is a view showing appearance of a flat firing tip.
Figure 4B:
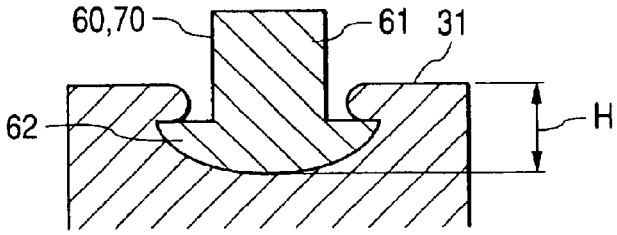
FIG. 4B is a cross-sectional view explaining definition of an embedding depth H.
Figure 4C:
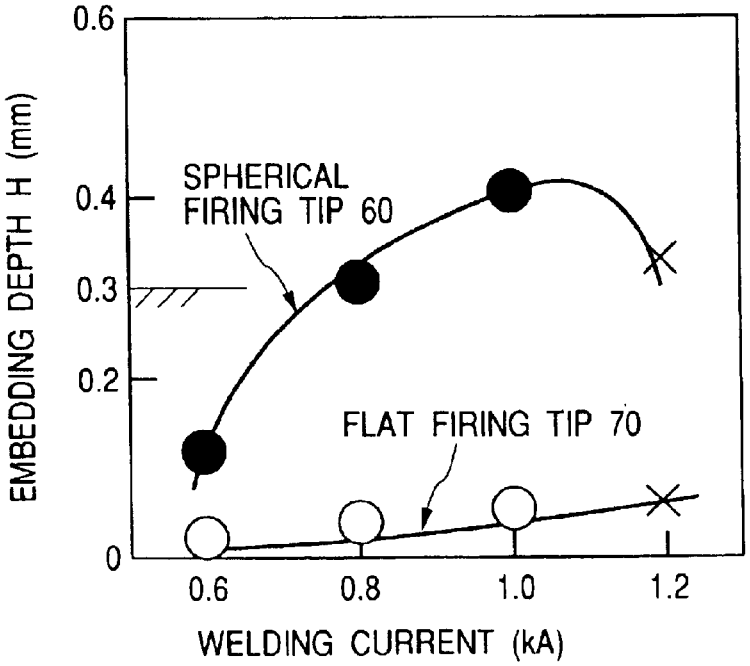
FIG. 4C is a graph showing relationship between the welding current and the embedding depth H.

FIGS. 4A, 4B and 4C show evaluation result on the embedding arrangement of the Ir alloy firing tip 60 relative to the opposing portion 31 in relation to the welding current of the above-described resistance welding. In view of embedding of the head 62 as well as anti-buckling of the stem 61, a preferable pressing force applied to the Ir alloy firing tip 60 during the resistance welding is within a range of 200N to 400N. The test shown in FIGS. 4A to 4C was conducted under the pressing force of 250N and the cycle number of 10 with the parameter of welding current.

Two Ir alloy firing tips were tested. One of the tested firing tips is a spherical firing tip 60 having the spherical head 62 shown in FIGS. 3A and 3B. The other one of the tested firing tips is a flat firing tip 70 having a flattened heat 62 as shown in FIG. 4A. The tested firing tips 60 and 70 have the same thin diameter (d=0.7 mm), the same maximum diameter (D=1.2 mm), the same stem length (t0=0.6 mm), and the same head thickness (T0=0.3 mm). The spherical firing tip 60 has a curvature radius R equivalent to D/2 (=0.6 mm).

FIG. 4C shows the test result, with an abscissa representing welding current (kA) and an ordinate representing embedding depth H (mm). FIG. 4B shows the embedding depth H (mm). In FIG. 4C, a black plotting curve represents the spherical firing tip 60 while a while plotting curve represents the flat firing tip 70. The point×represents a buckling point of the stem 61 in each of the firing tips 60 and 70.

As understood from FIG. 4C, in the case of flat firing tip 70, the flattened head 62 did not sink in the opposing portion 31 and the stem 61 has buckled when the welding current is increased up to 1.2 kA. Like the flat firing tip 70, the stem 61 of the spherical firing tip 60 has buckled when the welding current is increased up to 1.2 kA. And, at 0.6 kA level of the welding current, the spherical head 62 of the spherical firing tip 60 did not completely sink in the opposing portion 31. However, when the welding current is within the range of 0.8 kA to 1.0 kA, the spherical head 62 has completely sunk in the opposing portion of the electrode without causing buckling of the stem 61.

As understood from the test result, the spherical configuration of this embodiment is advantageous in that the head 62 can easily sink in the opposing portion 31 under application of an appropriate pressing force during the resistance welding operation. FIG. 4C merely shows one test result. As far as the firing tip 60 has the above-described appropriate size, adequate embedding performance can be assured.

Figure 5A:
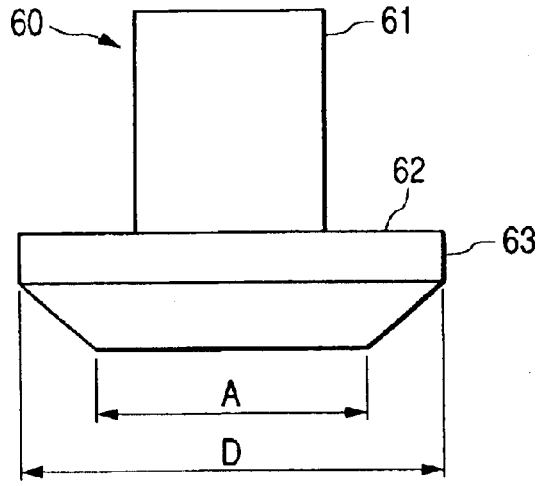
FIG. 5A is a view showing appearance and configuration of a tapered Ir alloy firing tip with a flat top surface in accordance with the first embodiment of the present invention.

The configuration of the firing tip head 62 is not limited to the above-described spherical shape and therefore can be modified into other one. For example, the firing tip head 62 may have a flat surface at its top when the cross-sectional area of the head 62 continuously decreases with increasing distance from the maximum diameter portion 63 as shown in FIG. 5A. FIG. 5A shows appearance and configuration of a tapered Ir alloy firing tip 60 whose diameter monotonously decreases from the maximum diameter portion 63 to the top (i.e., front end).

Figure 5B:
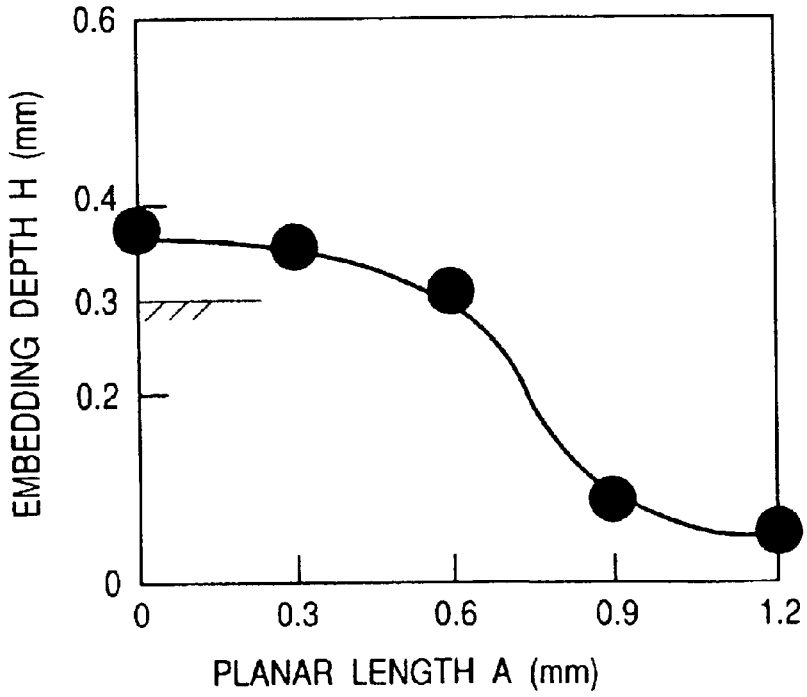
FIG. 5B is a graph showing relationship between a head planar length A and the embedding depth H.

When the firing tip head 62 has a flattened top, it is preferable that the radial length (i.e., head planar length) "A" of the top surface is smaller than a half of the maximum D, i.e., A<D/2, as shown in FIG. 5A. FIG. 5B is a graph showing a test result conducted for the relationship between the head planar length A and the embedding depth H.

FIG. 5B has an abscissa representing the head planar length A (mm) and an ordinate representing the embedding depth H (mm). The tested firing tip 60 has the same size (d=0.7 mm, D=1.2 mm, t0=0.6 mm, and T0=0.3 mm) as that shown in FIGS. 4A to 4C. As understood from this graph, the firing tip head 62 can easily sink when the head planar length A is small and does not sink when the head planar length A exceeds 0.6 mm.

From the foregoing, in the case of the Ir alloy firing tip 60 shown in FIG. 5A, sufficient embedding performance is not assured when the head planar length A is equal to or larger than D/2. Namely, the firing tip head cannot surely sink in the opposing portion of the electrode during the resistance welding operation. Hence, it is desirable that the relationship A<D/2 is satisfied. In the graph of FIG. 5B, when the head planar length A is 0, configuration of the firing tip head 62 is conical or the one shown in FIGS. 3A and 3B.

As described above, the present invention makes it possible to realize the spark plug 100 using the If alloy firing tip 60 which can assure long life (e.g., equivalent to traveling distance 100,000 km based on actual vehicle). Furthermore, by optimizing the size, configuration and embedding performance of firing tip 60 relative to the electrode, it becomes possible to obtain the reliable and excellent spark plug 100 capable of surely fixing the firing tip 60 based on low-cost resistance welding and preventing the firing tip 60 from falling out of the electrode.

The above-described spark plug 100 has two opposing portions 31 and 41 on the center electrode 30 and the ground electrode 40 which are disposed in an opposed relationship, with the Ir alloy firing tip 60 fixed on the opposing portion 31 of the center electrode 30 by resistance welding. Alternatively, it is possible to fix the Ir alloy firing tip 60 on the opposing portion (i.e., distal end) 41 of the ground electrode 40 by resistance welding. Furthermore, it is possible to fix the Ir alloy firing tip 60 on each of the opposing portions 31 and 41 of the center and ground electrodes by resistance welding.

Figure 6:
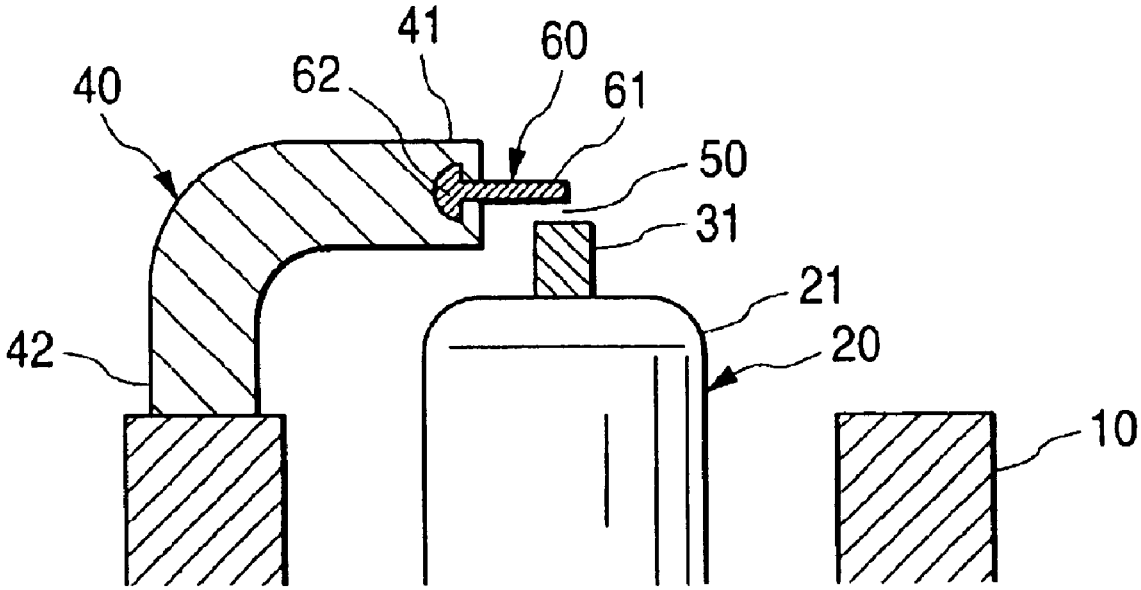
FIG. 6 is a cross-sectional view schematically showing a modified embodiment which has an Ir alloy firing tip fixed on the opposing portion of a ground electrode in accordance with the first embodiment of the present invention.

FIG. 6 schematically shows a modified embodiment of the first embodiment which has the Ir alloy firing tip 60 fixed on the opposing portion 41 of the ground electrode 40 by resistance welding. According to this modified embodiment, the Ir alloy firing tip 60 has the same arrangement and embedding structure as those of the firing tip 60 of the above-described spark plug 100. The resistance welding can be performed in the same manner. Thus, the modified embodiment can operate in the same manner with the same effects.

Figure 7A:
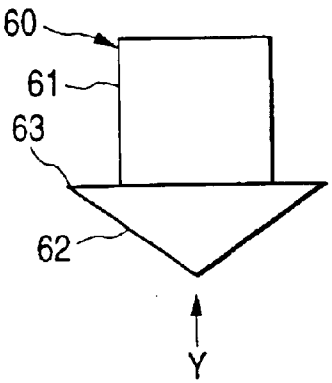
FIGS. 7A to 7H show various configurations of the Ir alloy firing tip in accordance with the first embodiment of the present invention.
Figure 7B:
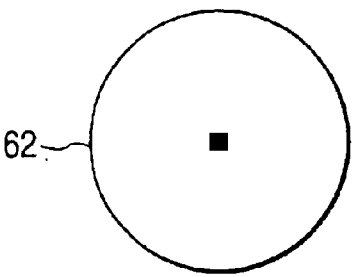
Figure 7C:
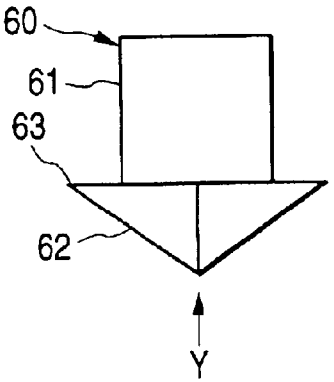
Figure 7D:
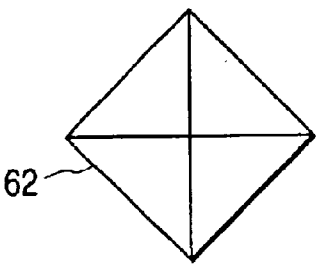
Figure 7E:
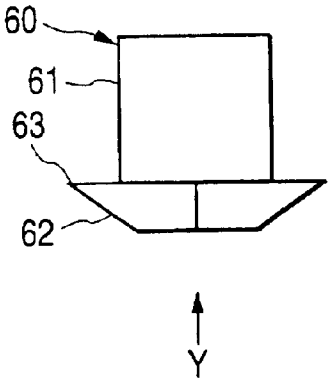
Figure 7F:
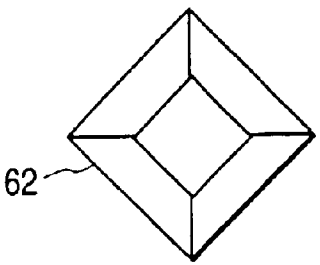
Figure 7G:
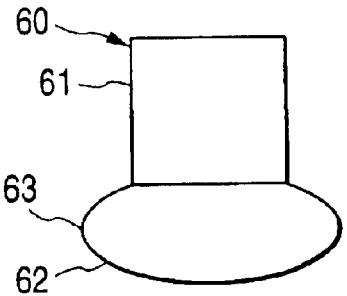
Figure 7H:
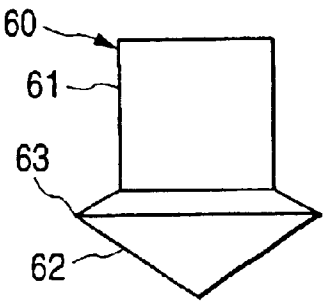

Besides the firing tips shown in FIGS. 2 to 5, the configuration of Ir alloy firing tip 60 applicable to the present invention are shown in FIGS. 7A to 7H. FIGS. 7B, 7D, and 7F are views seen from the direction Y shown in FIGS. 7A, 7C and 7E, respectively. Each embodiment shows unique rivet configuration or unique pointed or tapered head configuration.

Second Embodiment

According to the above-described first embodiment, the head 62 of the rivet Ir alloy firing tip 60 is fixed by resistance welding to at least one of the opposing portions 31 and 41 of the center electrode 30 and the ground electrode 40 which are disposed in an opposed relationship. The second embodiment is characterized in that fixing of Ir alloy firing tip 60 is performed based on caulking. Hereinafter, characteristic features of the second embodiment different from the first embodiment will be explained.

FIGS. 8A to 8D are cross-sectional views illustrating the caulking steps for fixing the firing tip 60 to the opposing portion 31 or 41. First, an axially extending hole 35 is opened on the opposing portion 31 or 41 by drilling operation (refer to FIG. 8A) so that the head 62 of the Ir alloy firing tip 60 can be inserted in this hole 35. Next, the Ir alloy firing tip 60 having the same arrangement as that disclosed in the first embodiment is inserted into the hole 35, with the head 62 as a leading side and the stem 61 following the head 62 and placed partly in the hole 35 (refer to FIG. 8B).

Next, the opposing portion 31 or 41 is caulked at its front end so that the diameter of the hole 35 becomes smaller than the maximum diameter of the head 62. For example, the caulking operation can be performed by using a knife member or a roller member. Through this caulking operation, as shown in FIG. 8C or 8D, the firing tip head 62 is securely fixed in the hole 35 with the maximum diameter portion 63 placed deeply in the hole 35 and the stem 61 surrounded by the deformed inside wall of the hole 35.

Accordingly, it becomes possible to securely fix the Ir alloy firing tip 60 to the opposing portion 31 or 41 in a hooked condition, thereby preventing the Ir alloy firing tip 60 from being mechanically pulled out of the opposing portion 31 or 41. Thus, this embodiment makes it possible to effectively fix the Ir alloy firing tip 60 to the electrode based on low-cost caulking operation.

Figure 8A:
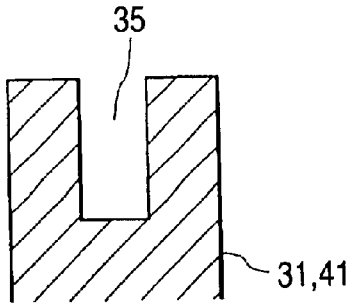
FIGS. 8A to 8D are cross-sectional views schematically illustrating caulking steps for fixing the Ir alloy firing tip to the electrode in accordance with a second embodiment of the present invention.
Figure 8B:
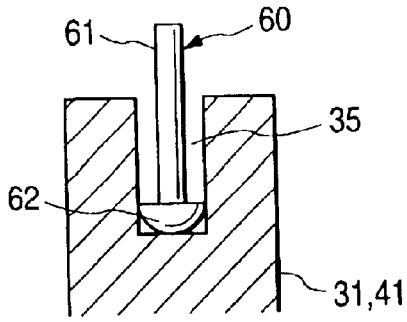
Figure 8C:
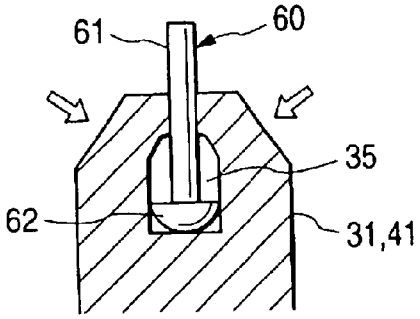
Figure 8D:
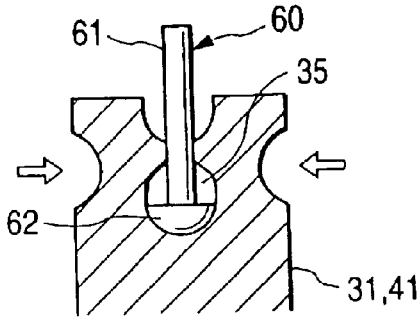
Figure 9:
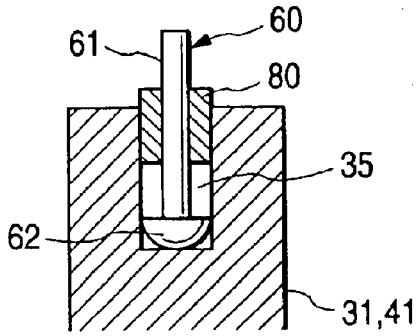
FIG. 9 is a cross-sectional view schematically showing a caulking operation using a separate member in accordance with the second embodiment of the present invention.

According to this embodiment, it is preferable to perform the resistance welding in the condition shown in FIGS. 8C or 8D so as to fix the Ir alloy firing tip 60 to the opposing portion 31 or 41. Furthermore, in the above-described caulking operation, it is possible to interpose a separate member (i.e., spacer) 80 between the stem 61 and the inside wall of the hole 35 as shown in FIG. 9. The separate member 80 is made of the same material (Ni-based alloy or the like) as that of the opposing portion 31 or 41. In the caulking operation, the separate member 80 is deformed integrally with the opposing portion 31 or 41 to securely fix the stem 61.

Furthermore, instead of performing the caulking operation, it is possible to integrate all of the firing tip 60, the separate member 80 and the opposing portion 31 or 41 by performing resistance welding operation after disposing the separate member 80 in the hole 35. In this case, it becomes possible to realize substantially the same embedding structure as that of the first embodiment, although the drilling operating is required.

Third Embodiment

Figure 10A:
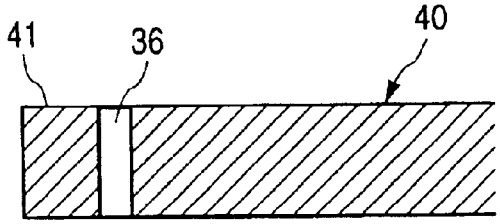
FIGS. 10A to 10C are cross-sectional views schematically showing the caulking steps for fixing the Ir alloy firing tip to the electrode in accordance with a third embodiment of the present invention.
Figure 10B:
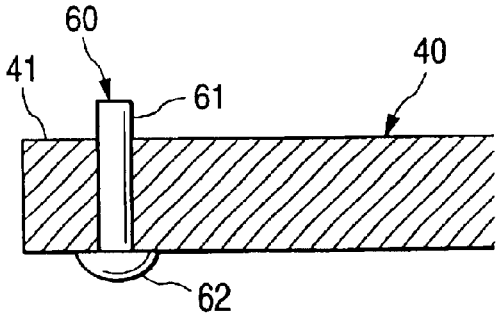
Figure 10C:
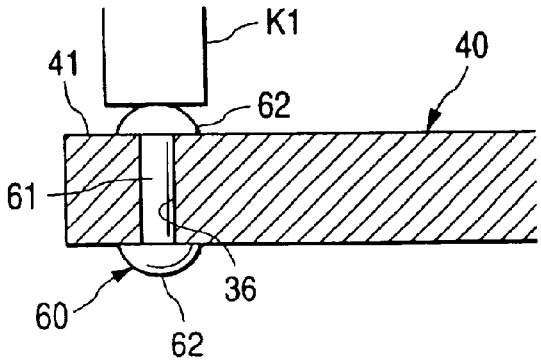

FIGS. 10A to 10C are cross-sectional views schematically showing the caulking steps for fixing the Ir alloy firing tip to the opposing portion of the electrode in accordance with the third embodiment. Third embodiment is based on a spark plug applicable to an internal combustion engine. The spark plug has an Ir alloy firing tip 60 disposed on the opposing portion (i.e., distal end) of the ground electrode 40. The Ir alloy firing tip 60 is a twin-headed type having two heads 62 at both ends of the stem 61 as shown in FIG. 10C. A through-hole 36, opened at the opposing portion 41 of the ground electrode 40, accommodates the stem 61. Two heads 62 are fixed to the opposing portion 41 so as to close each end of the through-hole 36.

First, as shown in FIG. 10A, the through-hole 36 is opened on the distal end (i.e., opposing portion) 41 of the ground electrode 40 through drilling operation. An inner diameter of the through-hole 36 is large enough to insert the stem 61 of the Ir alloy firing tip 60 and is smaller than the maximum diameter D of the head 62. Next, like the first embodiment, the stem 61 of Ir allow firing tip 60 is inserted into the through-hole 36 with its free end far from the head 62 as a leading side (refer to FIG. 10B).

Next, as shown in FIG. 10C, an electrode K1 of a resistance welding apparatus is depressed on the free end of the stem 61 protruding from the through-hole 36 to thermally deform the free end of the stem 61 with heat available from the electrode K1 of the resistance welding apparatus. As a result, two heads 62 are formed at both ends of the stem 61. Each head 62 has a diameter larger than the inner diameter of the through-hole 36. Thus, the heads 62 are firmly fixed to the opposing portion 41 at both ends of the through-hole 36 so as to prevent the Ir alloy firing tip 60 from being pulled out of the through-hole 36.

As described above, the third embodiment makes it possible to realize an excellent firing tip fixing method based on the resistance welding, i.e., without using expensive laser welding. As a result, the third embodiment provides a low-cost method for preventing the Ir alloy firing tip 60 from being pulling out of the opposing portion 41. According to this embodiment, it is possible to form two heads by deforming both ends of a simple rodlike firing tip inserted in the through-hole 36.

The present embodiments as described are therefore intended to be only illustrative and not restrictive, since the scope of the invention is defined by the appended claims rather than by the description preceding them. All changes that fall within the metes and bounds of the claims, or equivalents of such metes and bounds, are therefore intended to be embraced by the claims.

What is claimed is:

1. A manufacturing method for a spark plug employed in an internal combustion engine, said spark plug comprising a center electrode and a ground electrode disposed in an opposed relationship, and an iridium alloy firing tip fixed to at least one of opposing portions of said electrodes by resistance welding, wherein said iridium alloy firing tip chiefly contains iridium, said iridium alloy firing tip comprises a stem and a head, said head being integrally formed from a base end of said stem with a diameter of said head larger than a diameter of said stem, said head having a cross-sectional area continuously decreasing with increasing distance from a maximum diameter portion positioned close to said stem to a distal end positioned remote from said stem, said manufacturing method comprising a welding operation for fixing said iridium firing tip to said opposing portion by resistance welding, said welding operation comprising the steps of:

bringing said distal end of said head of said iridium alloy firing tip into contact with said opposing portion, and applying a pressing force to said head during resistance welding operation for forcing said maximum diameter portion to sink in a melted portion of said opposing portion until the base end of said stem extending from paid maximum diameter portion is embedded in said melted portion of said opposing portion; and further comprising a step of caulking said opposing portion after said head of the firing tip is embedded in said opposing portion, so that said base end of said stem extending from said maximum diameter portion is surrounded or wrapped by said opposing portion.

2. A spark plug for an internal combustion engine comprising:

a center electrode and a ground electrode disposed in an opposed relationship, and an iridium alloy firing tip provided on at least one of opposing portions of said electrodes, wherein said iridium alloy firing tip chiefly contains iridium, said iridium alloy firing tip comprises a stem and a head, said head being integrally formed from a base end of said stem with a diameter of said head larger than a diameter of said stem, a distal end of said stem is opposed to an opponent electrode, said head is placed in a hole formed in said opposing portion, and said head has a maximum diameter portion positioned in said hole and said opposing portion is caulked so that a base end of said stem extending from said maximum diameter portion is wrapped or surrounded by an inside wall of said hole.

3. The spark plug for an internal combustion engine in accordance with claim 2, wherein said iridium alloy firing tip contains at least one additive selected from the group consisting of rhodium, platinum, ruthenium, palladium and tungsten.

4. A spark plug for an internal combustion engine comprising:

a center electrode and a ground electrode disposed in an opposed relationship, and an iridium alloy firing tip provided on an opposing portion of said ground electrode, wherein said iridium alloy firing tip comprises a stem and two heads formed at both ends of said stem, with a diameter of each head larger than a diameter of said stem, a through-hole is provided on said opposing portion for accommodating said stem, and said two heads are fixed to said opposing portion so as to close each end of said through-hole.

5. The spark plug for an internal combustion engine in accordance with claim 4, wherein said iridium alloy firing tip chiefly contains iridium with at least one additive selected from the group consisting of rhodium, platinum, ruthenium, palladium and tungsten.

* * * * *